United States Patent [19]

Rothenbuhler

[11] Patent Number: 4,814,664

[45] Date of Patent: Mar. 21, 1989

[54] IGNITER WITH WEAR INDICATOR

[75] Inventor: Tom L. Rothenbuhler, Toledo, Ohio

[73] Assignee: Champion Spark Plug Company, Toledo, Ohio

[21] Appl. No.: 156,260

[22] Filed: Feb. 16, 1988

[51] Int. Cl.[4] ..... H01T 13/52; H01T 13/32

[52] U.S. Cl. ..... 313/131 R; 313/131 A; 313/130; 313/138; 313/139; 116/208

[58] Field of Search ..... 313/131 A, 131 R, 130, 313/139, 138; 116/208

[56] References Cited

U.S. PATENT DOCUMENTS

| | | | |
|---|---|---|---|
| 1,468,929 | 9/1923 | Strawser | 313/139 X |
| 3,228,735 | 1/1966 | Stewart | 308/38 |
| 3,414,272 | 12/1968 | Rogers, Jr. | 277/2 |
| 3,438,351 | 4/1969 | Kirkwood | 116/124 |
| 3,565,352 | 2/1971 | Rea | 241/182 |
| 3,574,269 | 4/1971 | Rea | 52/105 |
| 3,587,516 | 6/1971 | Wainscott | 116/114 |
| 3,842,792 | 10/1974 | Souther | 116/114 Q |
| 3,998,317 | 12/1976 | Stinnett | 198/341 |
| 4,023,058 | 5/1977 | Lara et al. | 313/139 |
| 4,641,877 | 2/1987 | Merrill | 294/101 |

FOREIGN PATENT DOCUMENTS

| | | | |
|---|---|---|---|
| 345779 | 4/1931 | United Kingdom | 313/131 |

OTHER PUBLICATIONS

P. 12, "Turbine Engine Igniter Application & Service Manual", 1982.

*Primary Examiner*—Palmer C. DeMeo

*Attorney, Agent, or Firm*—MacMillan, Sobanski & Todd

[57] ABSTRACT

A wear indicator for an igniter of the type having a center electrode, an annular ground electrode surrounding the center electrode, and a spark gap between the electrodes extending along a surface of a ceramic material. An annular wear indicating groove is formed in the ground electrode to indicate when the ground electrode is sufficiently eroded to necessitate replacement of the igniter. For a low voltage igniter the ceramic material at the spark gap is a semiconductor material which also is subject to erosion during use. A wear indicating groove also may be formed on the center electrode at a location which becomes exposed to indicate when the semiconductor material is sufficiently eroded to necessitate replacement of the igniter.

2 Claims, 1 Drawing Sheet

IGNITER WITH WEAR INDICATOR

TECHNICAL FIELD

The invention relates to igniters and spark plugs and more particularly to an igniter of the surface gap type having an annular ground electrode which includes an erosion wear indicator. As used herein, the term igniter shall include high voltage and low voltage gas turbine igniters and spark plugs of the surface gap type having an annular spark gap sometimes used in automotive and marine engines, for example.

BACKGROUND ART

In certain engine applications such as in aircraft turbine engines, fuel is ignited by an igniter of the surface gap type. In a high voltage igniter of the surface gap type and in a surface gap spark plug, the spark travels along the surface of a ceramic insulator between a center electrode and an annular ground electrode which surrounds the center electrode. In a low voltage igniter, the spark travels along a semiconductor surface located between the center electrode and the surrounding ground electrode. In either type of igniter, the ground electrode is subject to spark erosion during use. A special tool or gauge is required to inspect and check for wear on the ground electrode. For the low voltage igniter, the semiconductor surface also is subject to wear during use. As the semiconductor surface wears, an increasing portion of the center electrode is exposed.

It is often difficult for a mechanic to tell when an igniter is sufficiently worn to require replacement. Since igniters are expensive, premature replacement should be avoided. However, failure to replace a worn out igniter could lead to catastrophic results if the igniter is used, for example, in an aircraft engine.

DISCLOSURE OF INVENTION

The present invention is for an improved igniter of the type having a surface gap. The igniter includes a center electrode and an annular ground electrode which is spaced from the center electrode to form an annular spark gap. According to the invention, an annular wear indicating groove is formed on the end of the igniter in the ground electrode at a location of the maximum safe electrode wear. When the ground electrode is worn to the wear indicating groove, a mechanic knows that the igniter should be replaced rather than serviced. For low voltage igniters, a wear indicating groove also is formed on the center electrode at a preselected location spaced from the electrode end. When the igniter is new, the center electrode wear indicating groove is covered by the semiconductor material. When the semiconductor surface at the spark gap erodes to the maximum safe point, the indicator groove on the center electrode becomes exposed to inform the mechanic that the igniter should be replaced.

Accordingly, it is an object of the invention to provide one or more wear indicators on an igniter of the surface gap type to show when the igniter should be replaced.

Other objects and advantages of the invention will be apparent from the following description and the accompanying drawings.

BEST MODE FOR CARRYING OUT THE INVENTION

Figure 1:
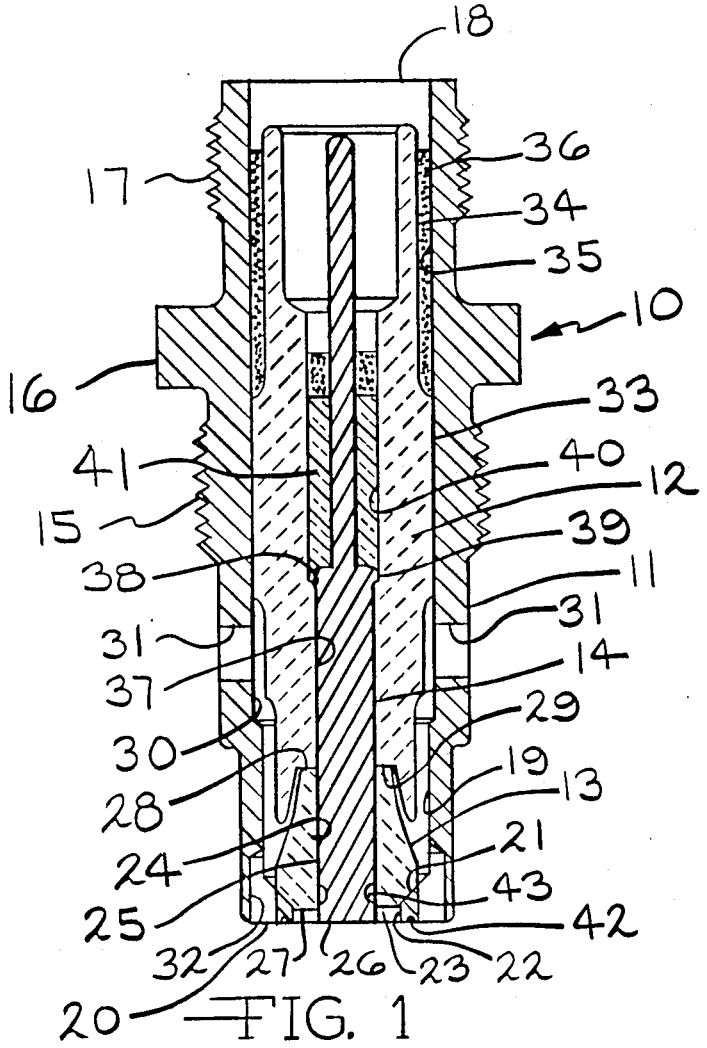
FIG. 1 is a vertical cross sectional view through a low voltage igniter including wear indicator grooves on the ground electrode and on the center electrode according to the invention.
Figure 2:
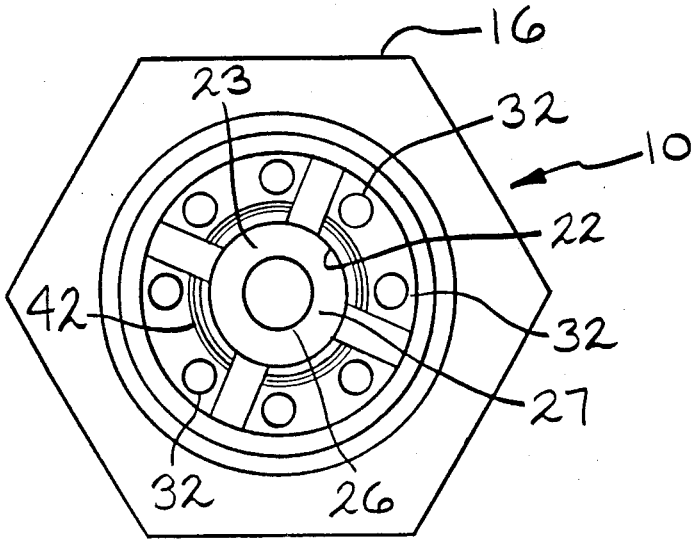
FIG. 2 is a lower end view of the igniter of FIG. 1.

Turning to the drawings, details are shown for an exemplary low voltage gas turbine aircraft engine igniter 10. The igniter 10 includes a shell 11, a ceramic insulator 12 mounted in the shell, a semiconductor body 13, and a center electrode 14. The shell 11 is tubular shaped and has on its outer surface a threaded section 15 for attaching the igniter 10 to an engine, a hexagonal section 16 to facilitate installation and removal of the igniter 10 with a wrench, and a threaded section 17 adjacent an upper end 18 for attaching the end of an ignition cable. The shell 11 has a stepped central opening or bore 19 for receiving the insulator 12 and the semiconductor body 13. At a lower end 20, the shell 11 extends radially inwardly to form a seat 21 on which the semiconductor body 13 is seated. An innermost annular edge 22 at the lower shell end 20 forms the ground electrode side of a spark gap 23.

The semiconductor body 13 is shaped to fit within the shell bore 19 to rest on the seat 21. The body 13 has a central opening 24 for passing a lower portion 25 of the center electrode 14. The lower portion 25 terminates at an end 26 which projects past a lower end surface 27 on the body 13 for forming a second side of the spark gap 23. The surface 27 extends across or shunts the spark gap 23. Since the surface 27 has semiconducting properties, a spark across the gap 23 will travel along the surface 27.

The insulator 12 is seated against an upper end 28 of the body 13. The insulator 12 has a lower end 29 which is spaced inwardly from the shell 11 to form a chamber 30. Near its upper end, the chamber 30 is vented through openings 31 through the shell 11. At its lower end, the chamber 30 extends past the semiconductor body 13 and is vented through openings 32 through the lower shell end 20. Above the chamber 30, the insulator 12 has an enlarged diameter section 33 which abuts the wall of the shell bore 19 to center the insulator 12 in the bore 19. Above the section 33, the insulator 12 has a reduced diameter section 34 to form with the shell 11 an annular pocket 35 which is packed with a suitable particulate sealing material 36. The material 36 retains the insulator 12 in the shell seated against the semiconductor body 13 and also form a gas tight seal which prevents leakage of combustion gases between the shell 11 and the insulator 12.

The insulator 12 has an axial bore 37 with includes a step 38. The center electrode 14 is positioned in the bore 37 with an enlarged diameter shoulder 39 seated on the step 38. An annular chamber 40 formed above the shoulder 39 contains a fused glass seal 41 which retains the center electrode 14 in the insulator 12 and prevents leakage of combustion gases between the insulator 12 and the center electrode 14.

During operation of the igniter 10, the annular ground electrode edge 22 on the shell 11 is subject to spark erosion which causes a gradual increase in the width of the spark gap 23. Some growth in the spark gap 23 is acceptable. However, when the spark gap 23 becomes too large, the igniter 23 will begin to miss and eventually will altogether fail to fire. In the past, a special tool has been required to measure the annular spark gap and a judgement decision had to be made by the mechanic as to whether the ignite was still safe to use. According to the invention, an annular groove 42 is formed in the lower shell end 20. The groove 42 is located coaxial with the center electrode end 26 and is spaced radially outwardly from the location of the edge 22 when the igniter 10 is new. As the edge 22 erodes, it approaches the groove 42. The groove 42 is located to indicate when said annular edge 22 is sufficiently worn to require replacement of said igniter. Accordingly, a mechanic can readily tell when the igniter 10 should be replaced due to excessive erosion of the ground electrode without making a judgement decision.

In low voltage igniters, it is necessary to shunt the spark gap 23 with the semiconductor surface 27 to obtain a spark across the gap 23. The semiconductor body 13 may be made, for example, from silicon carbide. The semiconductor body 13 is subject to greater erosion than an alumina insulator, for example. Eventually, the surface 27 will erode to the point that the igniter 10 must be replaced. In the past, a mechanic had to make a judgement decision to replace or to reuse the igniter based upon its appearance. As the surface 27 erodes, an increasing amount of the lower center electrode portion 25 is exposed. According to a second feature of the invention, a wear indicating groove 43 is formed around the lower electrode portion 25. The groove 43 is spaced from the electrode end 26 to be normally covered by the semiconductor body 13 and to be exposed when the semiconductor body 13 is sufficiently worn to require replacement of the igniter 10. Thus, the igniter 10 will be replaced at the proper time without the risk of an improper judgement decision by the mechanic.

Although the above described igniter 10 is of the low voltage type having a specific construction, the invention is applicable to other types of igniters. In a modified constrction for a low voltage igniter, the semiconductor body 13 is formed as an integral part of the insulator 12. The insulator 12 has high electrical insulation properties. However, the lower end adjacent the spark gap surface 27 is impregnated with resistance modifiers to produce the desired semiconductor properties. In a high voltage igniter, an insulator forms the spark gap surface 27. The insulator may be formed, for example, from alumina. Since erosion of the alumina insulator is significantly less than erosion of the center electrode 14 and of the ground electrode edge 22, it is not necessary to form a wear indicating groove 43 on the center electrode 14. According to the invention, only the groove 42 in the annular ground electrode at the lower end of the igniter is required in the high voltage igniter to inform the mechanic when the igniter should be replaced due to excessive erosion. In one type of igniter, the inner edge of ground electrode is formed from a corrosion resistant metal, such as iridium or platinum, which is attached to and forms a part of the shell end 20. Although erosion of the ground electrode will be significantly reduced, the wear indicating groove 42 still may be formed in the shell end 20.

It will be appreciated that various modifications and changes may be made without departing from the spirit and the scope of the following claims. In particular, it will be appreciated that the invention may be incorporated in various known designs for high voltage igniters, low voltage igniters and spark plugs, referred to generically herein as igniters, of the type having an annular ground electrode which is subject to erosion during use and a surface gap which in some designs also is subject to erosion during use.

I claim:

1. An igniter comprising a tubular shell having a threaded portion for attachment to an engine, an insulator mounted in said shell, a center electrode mounted in said insulator, said center electrode having an end forming one side of an annular spark gap, said shell defining a ground electrode having an inner edge spaced from said center electrode end for forming said spark gap, a surface formed from a ceramic material extending between said center electrode end and said ground electrode edge whereby a spark across said spark gap travels along said surface, and an annular wear indicating groove in said ground electrode at a location spaced radially outwardly from said inner edge when said igniter is new, said groove having a location to indicate when said inner edge is sufficiently eroded to necessitate replacement of said igniter.

2. An igniter, as set forth in claim 1, wherein said ceramic material is subject to erosion during use of said igniter, and further including a second wear indicating groove located on said center electrode, said second wear indicating groove having a location on said center electrode which is normally covered by said ceramic material and which is exposed when said ceramic material is sufficiently eroded to necessitate replacement of said igniter.

* * * * *